US008931555B2

(12) United States Patent
Krohn et al.

(10) Patent No.: US 8,931,555 B2
(45) Date of Patent: Jan. 13, 2015

(54) DEVICE FOR A DOWNHOLE APPARATUS FOR MACHINING OF CASINGS AND ALSO A METHOD OF DEPOSITING MACHINED SHAVINGS

(75) Inventors: Helge Krohn, Sandnes (NO); Mads Grinrød, Stavanger (NO)

(73) Assignee: West Production Technology AS, Stavanger (NO)

( * ) Notice: Subject to any disclaimer, the term of this patent is extended or adjusted under 35 U.S.C. 154(b) by 620 days.

(21) Appl. No.: 13/263,823

(22) PCT Filed: Apr. 12, 2010

(86) PCT No.: PCT/NO2010/000132

§ 371 (c)(1),
(2), (4) Date: Dec. 9, 2011

(87) PCT Pub. No.: WO2010/120180

PCT Pub. Date: Oct. 21, 2010

(65) Prior Publication Data

US 2012/0118570 A1 May 17, 2012

(30) Foreign Application Priority Data

Apr. 14, 2009 (NO) ..... 20091440

(51) Int. Cl.
*E21B 29/00* (2006.01)
*E21B 43/11* (2006.01)
*E21B 29/10* (2006.01)

(52) U.S. Cl.
CPC ..... *E21B 29/10* (2013.01)
USPC ..... 166/297; 166/298; 166/55; 166/55.7

(58) Field of Classification Search
CPC ..... E21B 43/08; E21B 43/082; E21B 43/084; E21B 43/086; E21B 43/088
USPC ..... 166/296, 297, 298, 311, 312, 55, 55.7; 175/312, 314
See application file for complete search history.

(56) References Cited

U.S. PATENT DOCUMENTS 2,482,674 A 9/1949 Kriegel
4,510,999 A * 4/1985 George et al. ..... 166/297

(Continued)

FOREIGN PATENT DOCUMENTS

CN 1069549 A 3/1993
CN 1179498 A 4/1998

(Continued)

OTHER PUBLICATIONS

International Search Report for parent application PCT/NO2010/000132, having a mailing date of May 21, 2010.

(Continued)

*Primary Examiner* — Brad Harcourt
*Assistant Examiner* — David Carroll
(74) *Attorney, Agent, or Firm* — Andrus Intellectual Property Law , LLP

(57) ABSTRACT

There is described a device for machining apparatus arranged for machining of a portion of a casing positioned in a wellbore, wherein a return fluid conduit extends from the machining apparatus in a direction toward a deposit area arranged in the wellbore. Also described is a method for machining of a portion of a casing positioned in a wellbore, wherein the method comprises the steps of: arranging a return fluid conduit between a machining apparatus and a deposit area or an area connected to the deposit area, providing a particle carrying liquid flow (M) in a direction from the machining apparatus and toward the deposit area, during the machining of the casing leading metal shavings into the liquid flow (M), and directing the liquid flow (M) into the return fluid conduit, as the metal shavings are held back and deposited in the wellbore.

16 Claims, 4 Drawing Sheets

(56) References Cited

U.S. PATENT DOCUMENTS

| | | | | |
|---|---|---|---|---|
| 5,018,580 | A | 5/1991 | Skipper | |
| 5,101,895 | A | 4/1992 | Gilbert | |
| 5,682,950 | A * | 11/1997 | Bjørnstad | 166/99 |
| 5,899,268 | A | 5/1999 | Lynde et al. | |
| 6,029,745 | A | 2/2000 | Broussard et al. | |
| 7,096,950 | B2 * | 8/2006 | Howlett et al. | 166/298 |
| 2002/0162659 | A1 * | 11/2002 | Davis et al. | 166/298 |
| 2005/0217854 | A1 * | 10/2005 | Hayes et al. | 166/297 |
| 2008/0156494 | A1 | 7/2008 | Abadie | |

FOREIGN PATENT DOCUMENTS

| | | | |
|---|---|---|---|
| CN | 1305562 | A | 7/2001 |
| CN | 2458344 | Y | 11/2001 |
| CN | 2479202 | Y | 2/2002 |

OTHER PUBLICATIONS

Written Opinion of the International Searching Authority for parent application PCT/NO2010/000132, having a mailing date of May 21, 2010.

* cited by examiner

DEVICE FOR A DOWNHOLE APPARATUS FOR MACHINING OF CASINGS AND ALSO A METHOD OF DEPOSITING MACHINED SHAVINGS

CROSS-REFERENCE TO RELATED APPLICATIONS

This application is the U.S. national stage application of International Application No. PCT/NO2010/000132, filed Apr. 12, 2010, which International application was published on Oct. 21, 2010 as International Publication No. WO 2010/120180 A1 in the English language and which application is incorporated herein by reference. The International application claims priority of Norwegian Patent Application No. 20091440, filed Apr. 14, 2009, which application is incorporated herein by reference.

BACKGROUND

A device for a downhole apparatus for machining of casings is described, more particularly a device arranged to direct machined shavings in a direction from a machining area toward the end portion of a well bore by means of a flowing well liquid, and to thereafter direct the well liquid to a surface installation. A method for depositing machined shavings in the well bore is also described.

When a well such as a hydro carbon producing well is to be shut in, there has to be established a plug such as a cement plug, according to public safety regulations and common practice, in the well bore above, i.e. downstream of the producing zone, as the plug has to be anchored in the structure above the producing zone. This implies among other things that portions of a metal casing extending through the well are removed where the plug is to be established. Such removal is done by means of machining of the casing from the inside of the pipe. In prior art the metal shavings from the mechanical machining are transported by means of flowing well liquid from the underground up to the surface where mechanical equipment is used to separate the metal shavings from the well liquid. Metal shavings are collected and brought to a treatment plant where they are cleaned of liquid remnants and used for example in the production of new metal products. The remaining products from the cleaning process, i.e. well liquid remnants and any cleaning liquid used, must be treated as hazardous waste.

The metal shavings removed from the casing are directed with the well liquid through pipe paths such as an annulus outside a feed pipe for the well liquid. There is a risk of the return path being blocked as a result of the metal shavings easily getting stuck in the flow path, or that the flow rate of the well liquid in the return pipe is too small compared with the rate of descent of the metal shavings. For that reason high flow rates are normally used requiring hydraulic pumps having very large power and correspondingly large mass and power consumption. In such operations, being mainly arranged for plugging and abandoning subsurface wells, it is a drawback that the pumping equipment is relatively heavy and power demanding compared to the rest of the equipment used. The equipment becomes less mobile and sets limitations, for example in transfer between ship and platform in work on sub-sea wells.

SUMMARY

The object of the invention is to remedy or reduce at least one of the disadvantages of the prior art.

The object is achieved in accordance with the invention and by virtue of the features disclosed in the following description and in the subsequent claims.

The invention provides a device and a method for depositing metal shavings cut by machining from a casing portion in an adjacent portion of the well bore, particularly in a portion of the well bore being further down in the well bore than the machined casing portion. By the expression "down" is implicitly meant an area lying further away from the mouth of the well bore than the casing portion, i.e. closer to the bottom portion of the well bore.

In a first aspect the invention relates more particularly to a machining apparatus device arranged to machine shavings from a portion of a casing arranged in a well bore, characterised in that a return fluid conduit extends from the machining apparatus in a direction toward a deposit area arranged in the well bore.

The return fluid conduit may be arranged for in a fluid communicating way to be able to drain the deposit area to a return path arranged to direct a liquid return flow out of the well bore.

The return path may be an annulus formed between a pipe string and a casing.

The return fluid conduit may be provided with an inflow filter arranged to hold back metal shavings from a particle carrying liquid flow.

The return fluid conduit may be provided with a stabiliser arranged to be able to be detachably fastened in the well bore above the deposit area.

The stabiliser may be provided with one or more through flow ports.

A portion of the return fluid conduit extending between the machining apparatus and the stabiliser may be telescopic.

A shavings conveyor arranged to at least being able to provide a relocation of the metal shavings in the axial direction of the well bore may be provided between the machining apparatus and the deposit area.

The shavings conveyor may comprise means arranged to boost the particle carrying liquid flow in a direction toward the deposit area.

The shavings conveyor may be an auger conveyor.

In a second aspect the invention relates more particularly to a method of machining a portion of a casing arranged in a wellbore, characterised in that the method comprises the steps:

- arranging a return fluid conduit between a machining apparatus and a deposit area or an area connected with the deposit area,
- providing a particle carrying liquid flow in a direction from the machining apparatus toward the deposit area,
- directing metal shavings during the machining of shavings from the casing into the liquid stream,
- directing the liquid flow into the return fluid conduit as the metal shavings being held back and deposited in the well bore.

The metal shavings may be held back from the particle carrying liquid stream by means of an inflow filter arranged at the return fluid conduit.

A portion of the return fluid conduit may be held fixedly relative to the deposit area by means of a stabiliser.

The machining apparatus may during the course of the machining be displaced in the axial direction of the well bore as a portion of the return fluid conduit extending between the machining apparatus and the stabiliser maintains a fluid communicating connection between the machining apparatus and the deposit area.

BRIEF DESCRIPTION OF THE DRAWINGS

In the following is described an example of a preferred embodiment illustrated in the accompanying drawings, wherein.

DETAILED DESCRIPTION OF THE DRAWINGS

Figure 1:
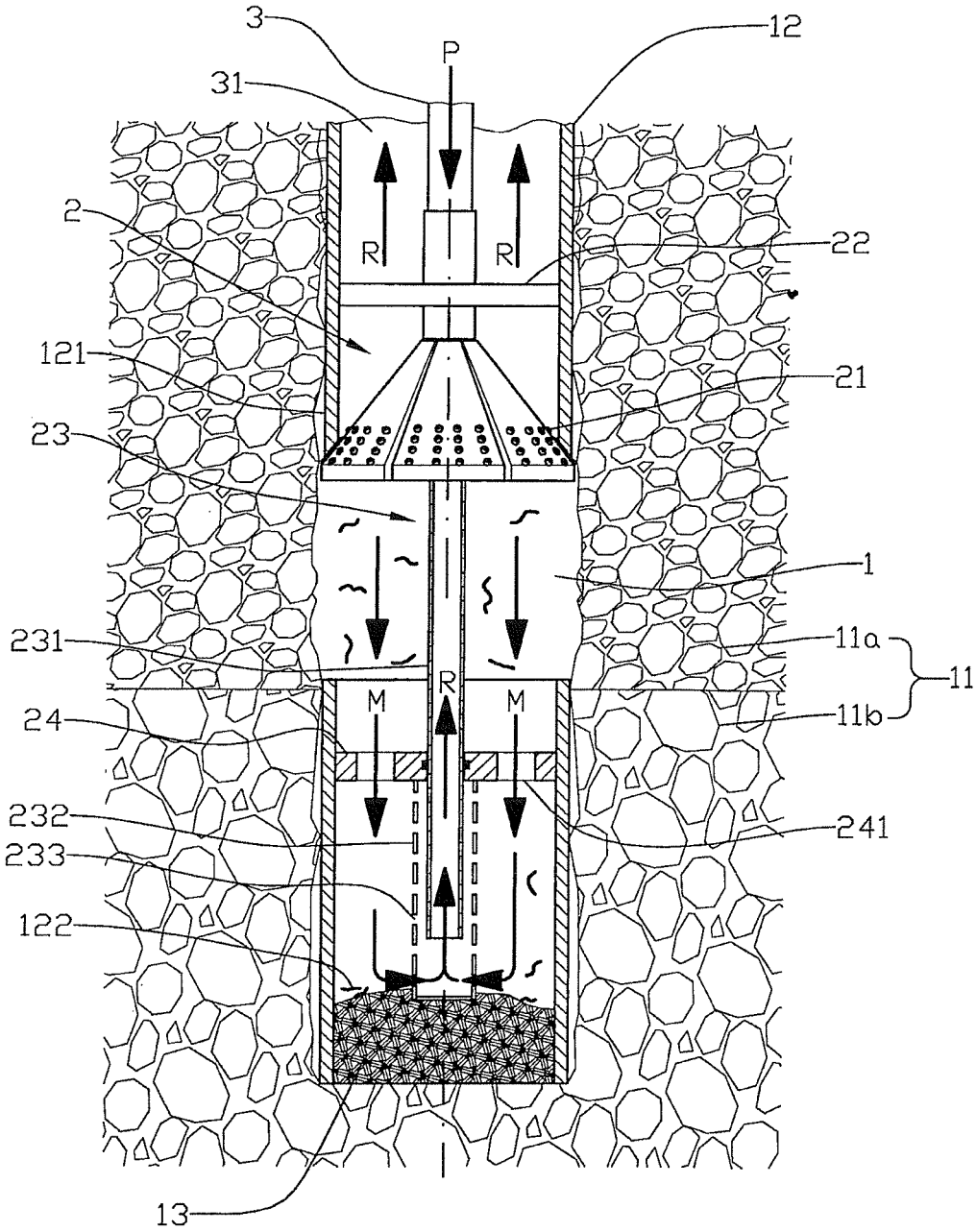
FIG. 1 shows in a partly sectioned side view a principle sketch of a first exemplary embodiment of a machining apparatus according to the invention, where a casing portion is machined away and the metal shavings are deposited in a portion of the well bore below the machining area, and a telescopic fluid conduit forms a return path from the deposit area to an annulus over the machining area.

In the figures the reference numeral 1 indicates a wellbore extending through parts of a subsurface structure 11, wherein layers 11*a*, 11*b* having different properties are indicated by different hatching, the lower layer 11*b* is for example a hydrocarbon bearing layer, while the upper layer 11*a* is a closed structure. The wellbore 1 is in a per se known way provided with a metal casing 12 bounding the wellbore 1 against the subsurface structure 11. A portion of the casing 12 to be machined is indicated by the reference numeral 121, and from this machining metal shavings 122 are released.

A deposit area 13 for metal shavings 122 is indicated in the bottom portion of the wellbore 1. For a person skilled in the art it is obvious that such a deposit area may be constituted by any portion of the well bore 1 having a suitable position relative to the zone of the casing 12 to be removed by machining. This will typically be the situation when a wellbore 1 extends through multiple producing layers 11*a*, wherein a deposit area 13 may be provided below and in conjunction with the zone to be machined, for example bounded against wellbore portions below by means of a plug (not shown) of a per se suitable, known type.

Figure 4:
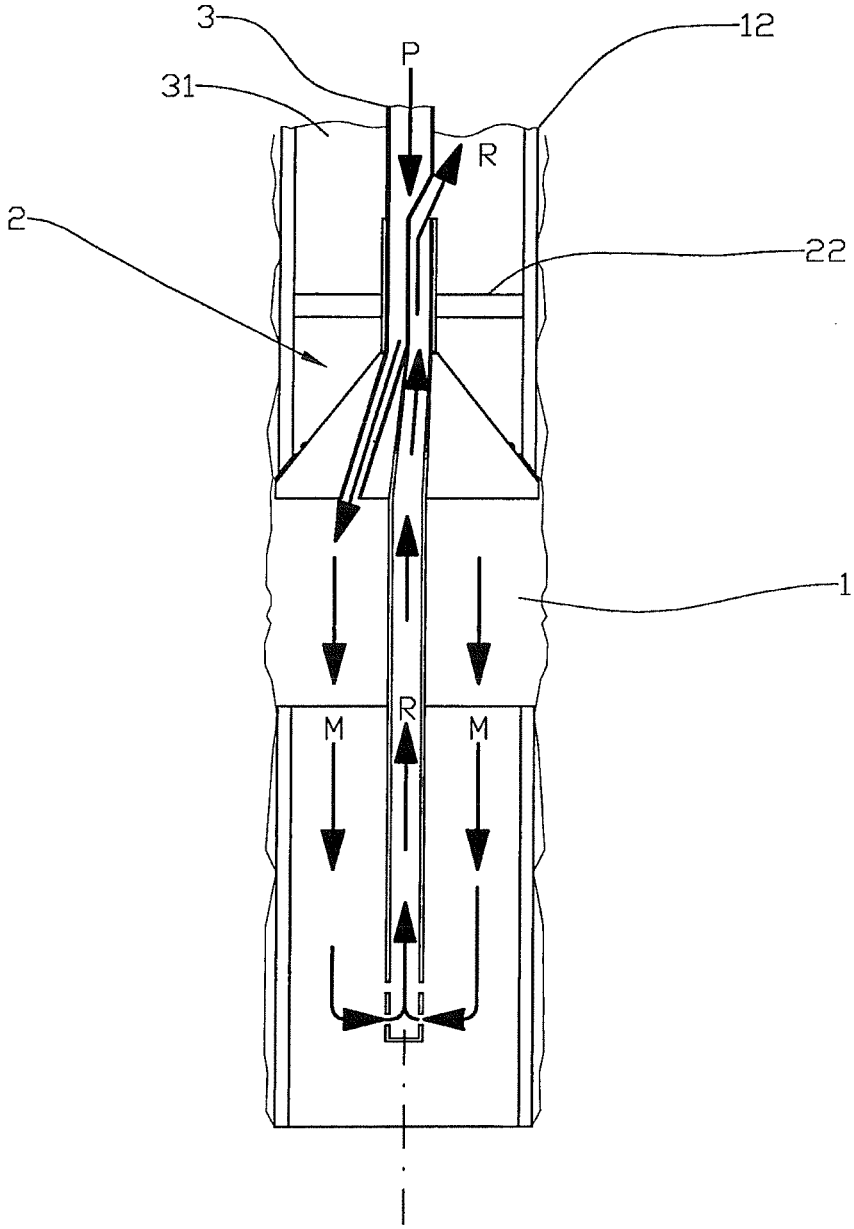
FIG. 4 shows schematically the liquid flow pattern in the machining apparatus according to the invention.

A machining apparatus 2 is in a per se known way connected to a pipe string 3 provided with a central longitudinal passage arranged for conveying a pressurised liquid flow P arranged for transporting the machined metal shavings 122, lubrication of the machining apparatus 2, and possible operation of the machining apparatus 2 if hydraulic operation is used instead of operation by rotation of the pipe string 3. The machining apparatus 2 is provided with a series of cutting tools 21 which in a per se known way are arranged for in an operative position to be able to be moved radially outward against the casing for machining of this. A barrier 22 defines sealingly an annulus 31 from the machining apparatus 2, the area to be machined and the deposit area 13. The annulus 31 is formed between the casing 12 and the pipe string 3 and extends up to the surface (not shown) where it is connected in a fluid communicating and a per se known way to a well fluid plant (not shown) arranged to maintain the pressurised liquid flow P and to receive and possibly process a liquid return flow R from the machining apparatus 2. See FIG. 4 concerning the flow pattern through the machining apparatus 2.

The machining apparatus 2 comprises means (not shown) arranged to direct the pressurised liquid flow P out into the machined zone below the machining apparatus 2.

A return fluid conduit 23 extends downward from the machining apparatus 2. It comprises an end section 232 provided with an inflow filter 233 arranged to be able to hold back metal shavings 122 being carried with a particle carrying liquid stream M toward the deposit area 13.

In a first embodiment, see FIG. 1, the return fluid conduit 23 is telescopic, as a telescope section 231 is axially displaceable in the end section 232. The end section 232 is releasably fastened to the telescope section 231 by means of a stabiliser 24. The stabiliser 24 is provided with multiple through flow ports 241 for the particle carrying liquid stream M.

Figure 2:
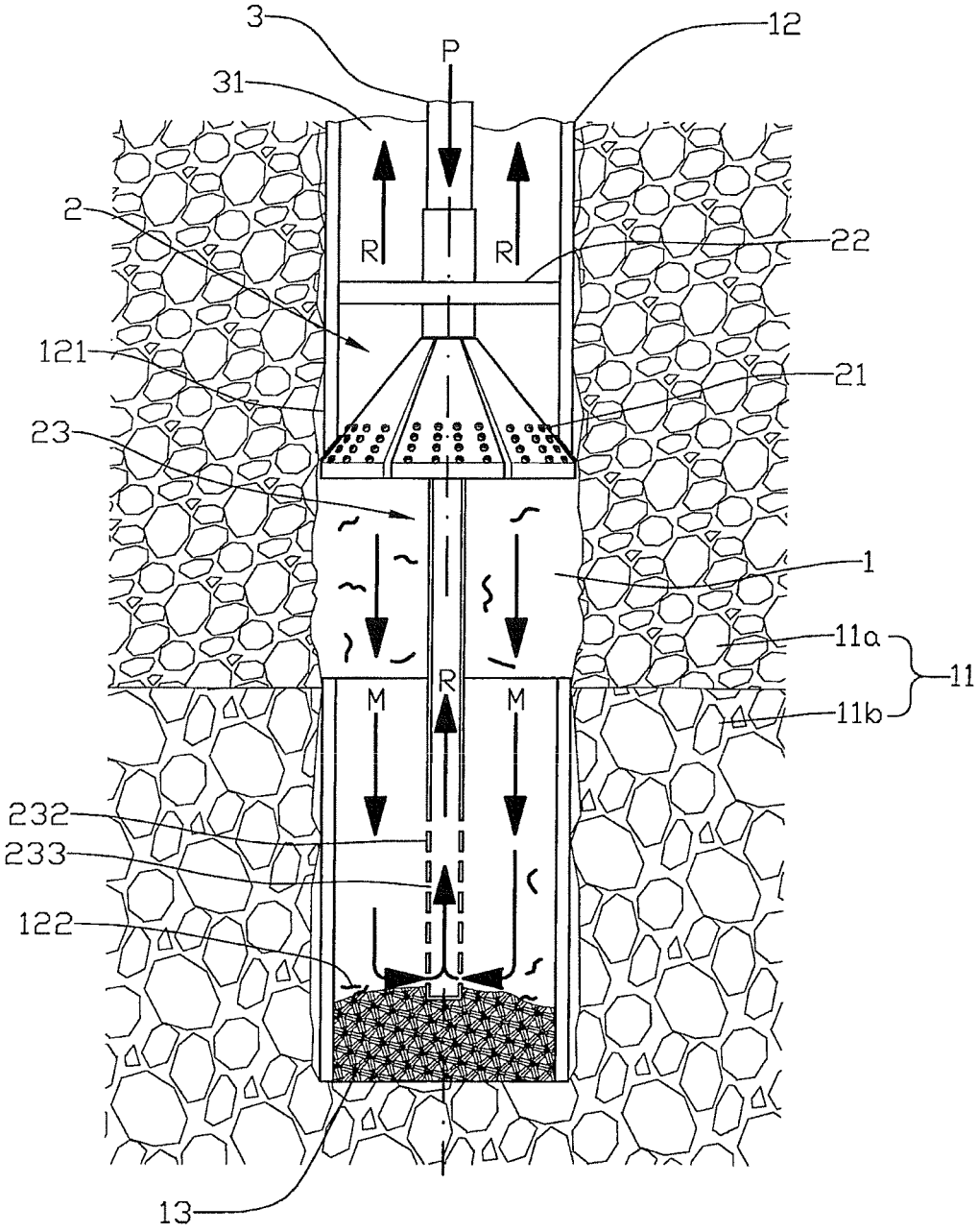
FIG. 2 shows in a partly sectioned side view a principle sketch of a second exemplary embodiment of the machining apparatus according to the invention, where a fluid conduit having a fixed length forms a return path from the deposit area to an annulus over the machining area.

In a second embodiment, see FIG. 2, the return fluid conduit 23 has a fixed length.

Figure 3:
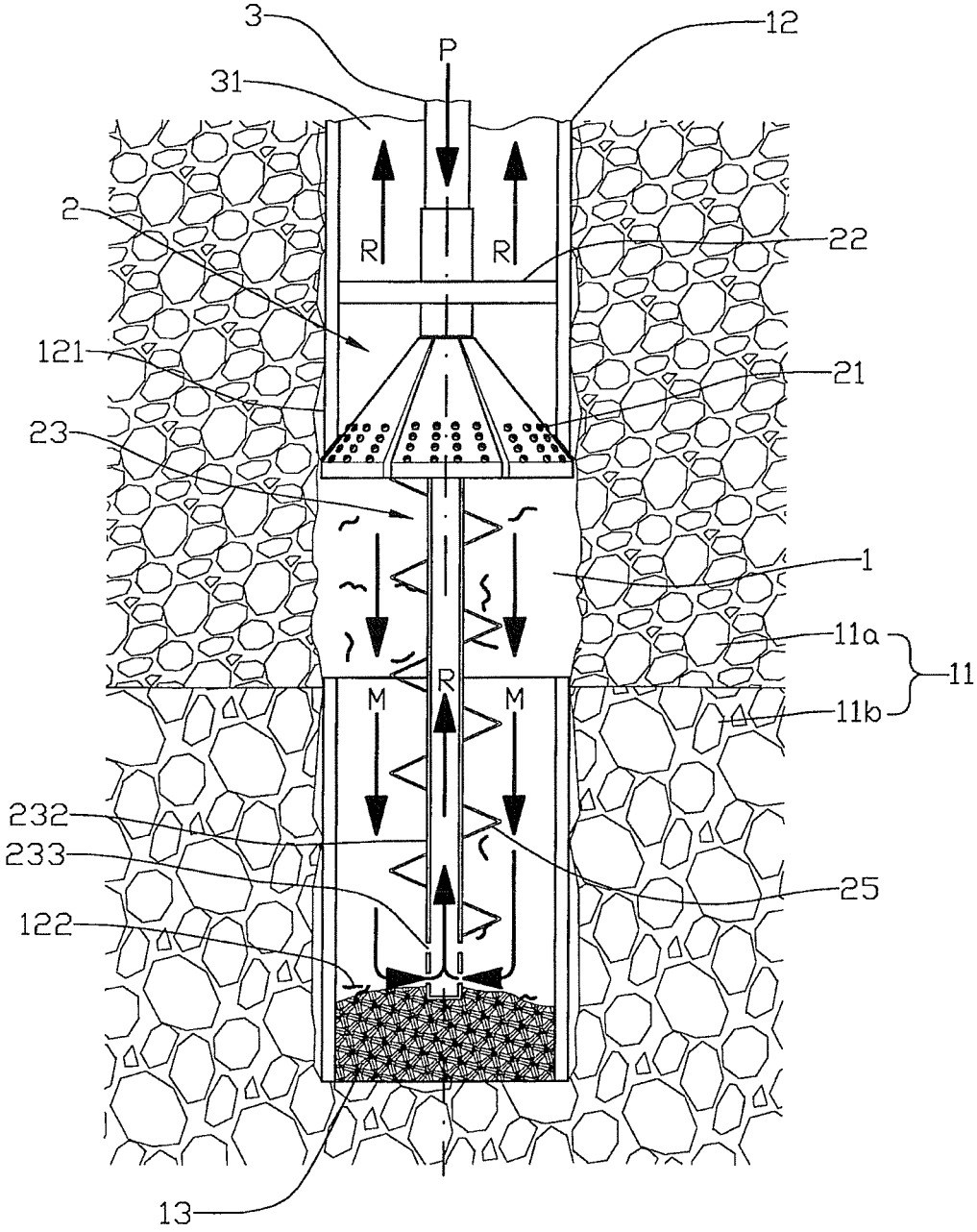
FIG. 3 shows in a partly sectioned side view a principle sketch of a third exemplary embodiment of the machining apparatus according to the invention, where in connection with the return fluid conduit a shavings conveyor is provided extending from the machining area toward the deposit area.

In a third embodiment, see FIG. 3, there is allocated to the return fluid conduit 23 a conveyor 25, indicated here as an auger surrounding the fluid return line 23, arranged to be able to improve the transfer of the metal shavings 122 particularly when the machining is taking place in horizontal portions of the wellbore. The conveyor 25 may be formed in a number of ways, for example as a fast rotating pump rotor affecting the flow rate of the particle carrying stream M, or a device working independently of the transporting ability of the liquid flow M.

When the casing 12 is to be machined, the machining apparatus 2 is led down into the wellbore 1 by means of the pipe string 3 to the furthermost end of the portion 121 to be machined. The pipe string 3 is connected to the well fluid plant (not shown) on the surface. The barrier 22 and possibly also the stabiliser 24 is set against the wall of the casing 12, and the flow P of pressurised liquid is established. The cutting tool 21 is activated by being set to rotate and is displaced toward the wall of the casing 12 for cutting interference with the casing 12. The metal shavings 122 is led with the particle carrying liquid stream M toward the deposit area 13, where the well fluid is drained into the return fluid conduit 23 while the metal shavings 122 are deposited or being held back by the inflow filter 233. The well fluid is led in the is liquid return flow R through the return fluid conduit 23 via the machining apparatus 2 and back to the surface via the annulus 31. The barrier 22 is being displaced continuously or stepwise as the machining apparatus 2 is relocated in the axial direction of the wellbore 1.

In the exemplary embodiment shown in FIG. 1 the end section 232 may have a length sufficient to be staying in the same position while the deposited metal shavings are building up around the end section 232. Alternatively there may be provided means (not shown) arranged to relocate the end section 232 as needed as the machining apparatus 2 is relocated in the axial direction of the wellbore 1. When the machining is completed and the machining apparatus 2 is brought up from the well bore 1 or relocated to another portion 121 to be machined, the end section 232 is brought along. Alternatively the end section 232 may be left behind in the deposit area 13, as the machining apparatus 2 is provided with a new end section 232 being made ready on the surface for another machining operation.

In the exemplary embodiments is shown a machining apparatus 2, which is relocated toward the surface during machining. It is also within the scope of the invention that the machining apparatus 2 has an opposite working direction.

The invention claimed is:

1. A machining apparatus for machining of a portion of a casing arranged in a wellbore in a downhole direction thereof thereby releasing metal shaving from the portion of the casing, the apparatus comprising a return fluid conduit that extends from the machining apparatus in the downhole direction toward a deposit area arranged downstream of the machining apparatus in the wellbore for receiving and isolating the metal shavings within the wellbore downstream of the machining apparatus by means of a particle carrying liquid stream passing through the machining apparatus, the return fluid conduit in fluid communication with the deposit area, the return fluid conduit arranged to drain the liquid stream through a return line and out of the wellbore without transferring the metal shavings into the return fluid conduit.

2. A machining apparatus according, to claim 1, wherein the return line is an annulus thrilled between a pipe string and a casing.

3. A machining apparatus according to claim 1, wherein the return fluid conduit is provided with an inflow filter arranged to hold metal shavings back from the particle carrying liquid stream.

4. A machining apparatus according to claim 1, wherein the return fluid conduit is provided with a stabiliser arranged to be able to be releasably fastened in the wellbore above the deposit area.

5. A machining apparatus according to claim 4, wherein the stabiliser is provided with one or more through flow ports.

6. A machining apparatus according to claim 4, wherein a portion of the return fluid conduit extending between the machining apparatus and the stabiliser, is telescopic.

7. A machining apparatus according to claim 1, wherein a shavings conveyor arranged to at least being able to provide a relocation of the metal shavings in the axial direction of the wellbore, is arranged between the machining apparatus and the deposit area.

8. A machining apparatus according to claim 7, wherein the shavings conveyor comprises means arranged to enhance the particle carrying liquid stream in a direction toward the deposit area.

9. A machining apparatus according to claim 7, wherein the shavings conveyor is a screw conveyor.

10. A machining apparatus according to claim 2, wherein the annulus includes a barrier sealingly attached between the pipe string and the casing.

11. A machining apparatus according to claim 10, wherein the barrier is displaced as the machining apparatus is relocated in an axial direction of the wellbore.

12. A method in the machining of a portion of a casing arranged in a wellbore in a downhole direction thereof, wherein the method comprises:

arranging a return fluid conduit between a machining apparatus and a deposit area downstream of the machining apparatus, providing a particle carrying liquid flow in a direction through the machining apparatus and toward the deposit area, during the machining of the casing leading metal shavings into the particle carrying liquid flow, directing the particle carrying liquid flow into the return fluid conduit, as the metal shavings are prevented from entering the return fluid conduit and deposited in the wellbore.

13. A method according to claim 12, wherein the metal shavings are prevented from entering the particle carrying liquid flow by means of an inflow filter arranged on a downstream end of the return fluid conduit.

14. A method according to claim 12, wherein a portion of the return fluid conduit is held fixedly relative to the deposit area by means of a stabiliser.

15. A method according, to claim 12, wherein the machining apparatus during the course of the machining is displaced in the axial direction of the wellbore as a portion of the return fluid conduit extending between the machining apparatus and the stabiliser maintains a fluid communicating connection between the machining apparatus and the deposit area.

16. A machining apparatus for machining a portion of a casing arranged in a wellbore in a downhole direction thereof thereby releasing metal shavings from the portion of the casing, the apparatus comprising a return fluid conduit that extends from the machining apparatus in the downhole direction towards a deposit area arranged downstream of the machining apparatus in the wellbore for receiving and isolating the metal shavings within the wellbore downstream of the machining apparatus by means of a particle carrying liquid stream passing through a pipe string and the machining apparatus, the return fluid conduit being, in fluid communication with the deposit area, the return fluid conduit arranged to drain the liquid stream through a return line and out of the wellbore without transferring the metal shavings into the return fluid conduit, wherein an inflow filter is provided away from the pipe string on an end section of the return fluid conduit extending towards a closed end of the wellbore, and wherein a barrier is sealingly attached between the pipe string and the casing and defines an annulus extending to a mouth of the wellbore.

* * * * *

UNITED STATES PATENT AND TRADEMARK OFFICE

CERTIFICATE OF CORRECTION

PATENT NO. : 8,931,555 B2
APPLICATION NO. : 13/263823
DATED : January 13, 2015
INVENTOR(S) : Helge Krohn and Mads Grinrod It is certified that error appears in the above-identified patent and that said Letters Patent is hereby corrected as shown below:

In the Claims

In column 5, line 17, claim 2, should read: A machining apparatus according, to claim 1, wherein the return line is an annulus formed between a pipe string and a casing.

Signed and Sealed this
Twenty-eighth Day of April, 2015

Michelle K. Lee

Michelle K. Lee
*Director of the United States Patent and Trademark Office*